US008298020B1

(12) United States Patent
Chen

(10) Patent No.: US 8,298,020 B1
(45) Date of Patent: Oct. 30, 2012

(54) CENTRAL CONDUCTOR OF COAXIAL CABLE CONNECTOR

(75) Inventor: Ming-Ching Chen, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 13/067,225

(22) Filed: May 18, 2011

(51) Int. Cl.
*H01R 11/22* (2006.01)

(52) U.S. Cl. ..... 439/852

(58) Field of Classification Search ..... 439/852, 439/578, 654, 582, 581, 638
See application file for complete search history.

(56) References Cited

U.S. PATENT DOCUMENTS 5,667,409 A * 9/1997 Wong et al. ..... 439/654
5,863,226 A * 1/1999 Lan et al. ..... 439/852
5,865,654 A * 2/1999 Shimirak et al. ..... 439/852
6,113,431 A * 9/2000 Wong ..... 439/638
6,276,970 B1 * 8/2001 Wong ..... 439/638
6,899,563 B1 * 5/2005 Lee ..... 439/578
7,931,509 B2 * 4/2011 Shaw et al. ..... 439/851
8,083,544 B2 * 12/2011 Chee ..... 439/578

* cited by examiner

*Primary Examiner* — Alexander Gilman
(74) *Attorney, Agent, or Firm* — Bacon & Thomas, PLLC

(57) ABSTRACT

A central conductor of coaxial cable connector includes a barrel, at least one first spring plate group, and at least one second spring plate group. The barrel has two ends forming connection bores, opposite side surfaces respectively forming a first slit and a second slit, and top and bottom walls respectively forming a wall opening and a bottom wall opening. The first spring plate group and the second spring plate group are arranged opposite in direction to each other and each includes spring plates that are arranged to engage each other from upper and lower sides. Each of the spring plates has an end connected to the top or bottom wall of the barrel and an opposite end extending inward of the top wall opening or the bottom wall opening. As such, clamping force is enhanced, contact area is increased, and resiliency limit is improved, so as to provide excellent engagement between conductors.

5 Claims, 9 Drawing Sheets

CENTRAL CONDUCTOR OF COAXIAL CABLE CONNECTOR

FIELD OF THE INVENTION

The present invention relates to an improved structure of central conductor of coaxial cable connector, wherein the central conductor is arranged inside a coaxial cable connector for connection with coaxial cables, as well as internal conductors thereof, which are of different specifications.

BACKGROUND OF THE INVENTION

To transmit signals in relation with applications of high frequency, video signals, and cable television systems, a coaxial cable connector is provided in the system for connecting at least one coaxial cable in order to accomplish the transmission of signal. With the significant progress in developing different types of electronic products, due to the concerns of frequency stabilization and reduction of transmission loss for signal transmission, coaxial cable connectors that have various specifications and mated coaxial cables have been developed for different types of electronic devices, in order to provide effective isolation against external interference.

A conventional coaxial cable connector comprises a central conductor, of which the structure of connection is composed of a pair of spring plates, which are respectively positioned on the upper and lower side to clamp an internal conductor of a coaxial cable therebetween. However, such a pair of spring plates is not mechanically strong enough to securely clamp the internal conductor of the coaxial cable, whereby it often occurs that the transmission of signal is unstable or even interrupted. Also, the clamped internal conductor of the coaxial cable may be easily pulled off.

Further, a variety of coaxial cables are available in the market and different coaxial cables have internal conductors that may be of different diameters. If poorly structured, the central conductor of the conventional coaxial cable connector, when put into mating engagement with an internal conductor of a coaxial cable, is susceptible to over-expansion of the connection structure of the central conductor, which often leads to resilient fatigue and improper clamping of the internal conductor of the coaxial cable by the connection structure.

Thus, the present invention aims to provide an improved structure of central conductor of coaxial cable connector, which enhances lamping force, increases contact area, and improves resiliency limit so as to realize excellent engagement between conductors.

SUMMARY OF THE INVENTION

An objective of the present invention is to provide a central conductor of coaxial cable connector, which enhances clamping force, increases contact area, and improves resiliency limit so as to realize excellent engagement between conductors.

To realize the above objectives, the present invention provides an improved structure of central conductor of coaxial cable connector, which comprises a barrel, at least one first spring plate group, and at least one second spring plate group. The barrel has front and rear ends forming connection bores, opposite side surfaces respectively forming a first slit and a second slit, and top and bottom walls respectively forming at least one top wall opening and at least one bottom wall opening corresponding to each other. The first spring plate group comprises two spring plates that engage each other from upper and lower sides and each of which has an end connected to the top or bottom wall of the barrel and an opposite end extending inward of the top wall opening and the bottom wall opening. The second spring plate group is arranged opposite in direction to the first spring plate group. The second spring plate group comprises two spring plates that engage each other from upper and lower sides and each of which has an end connected to the top or bottom wall of the barrel and an opposite end extending inward of the top wall opening and the bottom wall opening. The first spring plate group and the second spring plate group form a multi-point engagement structure.

As such, multiple pairs of spring plates are provided to enhance clamping force and prevent an internal conductor of a coaxial cable from being easily pulled off and increase contact area to provide excellent engagement between conductors, and multiple slits are provided to improve resiliency limit, and the barrel is integrally formed as a single piece to thereby reduce the cost.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

First Embodiment

Figure 1:
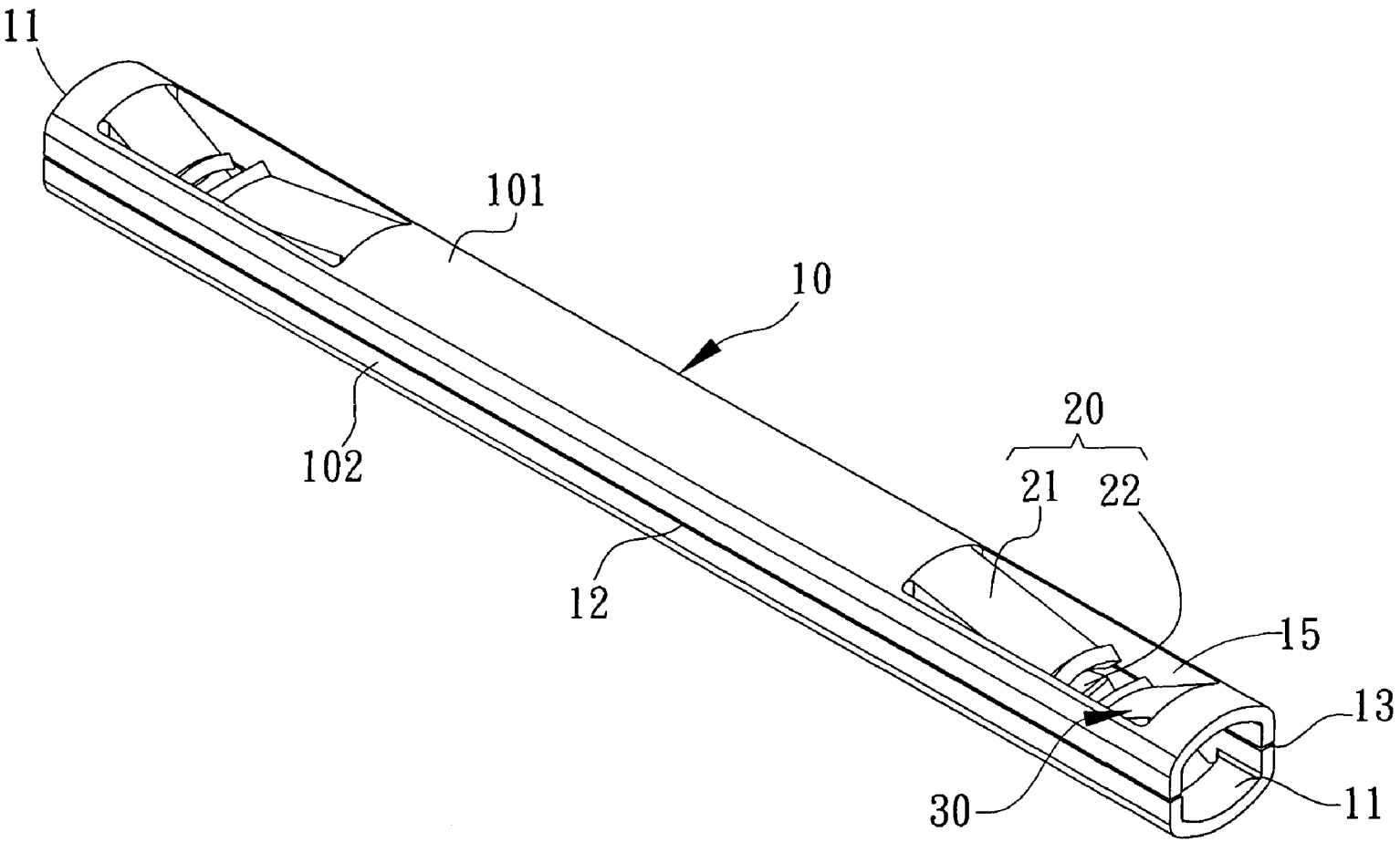
FIG. 1 is a perspective view of a first embodiment according to the present invention.
Figure 1A:
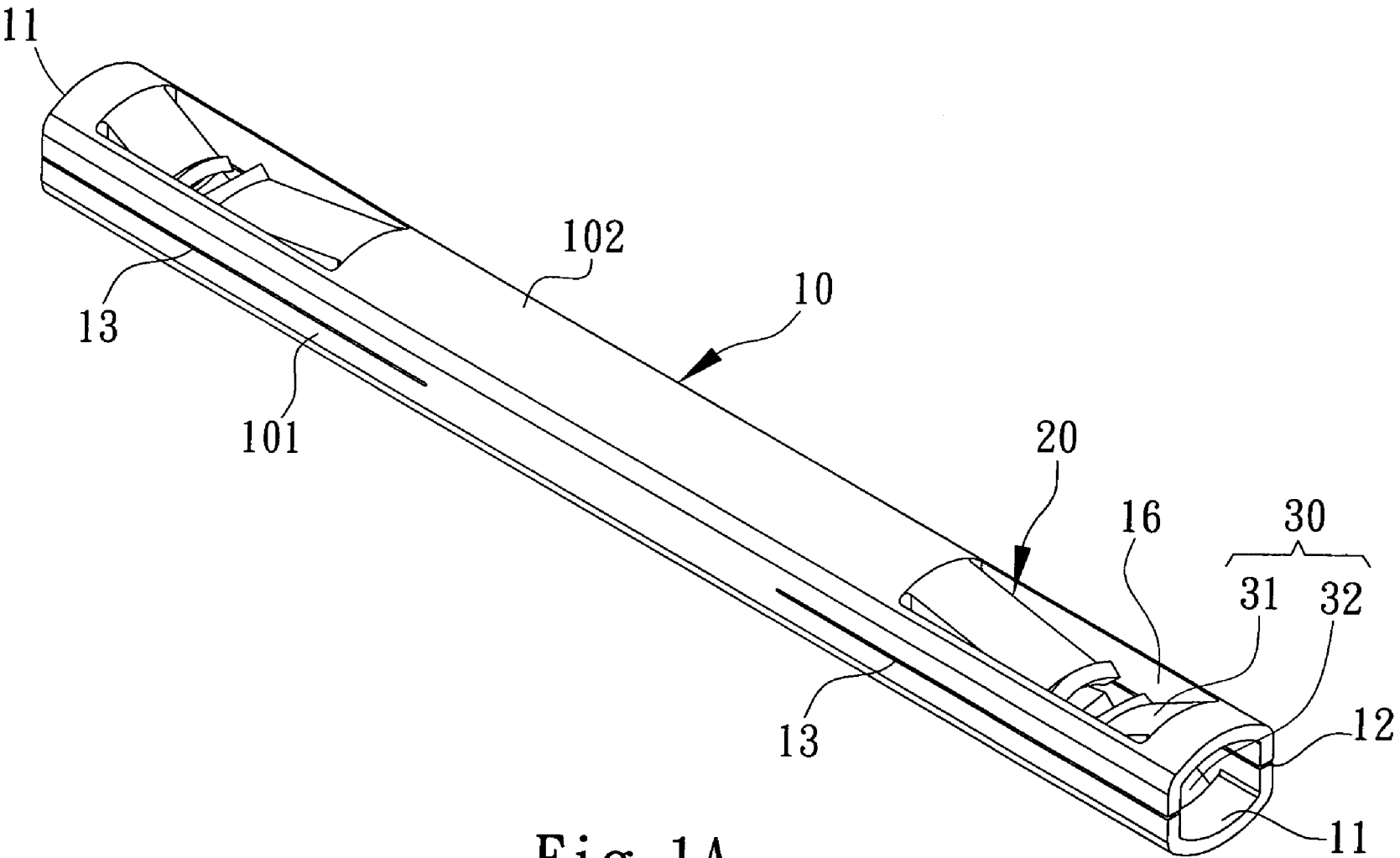
FIG. 1A is a different perspective view of the first embodiment according to the present invention.
Figure 2:
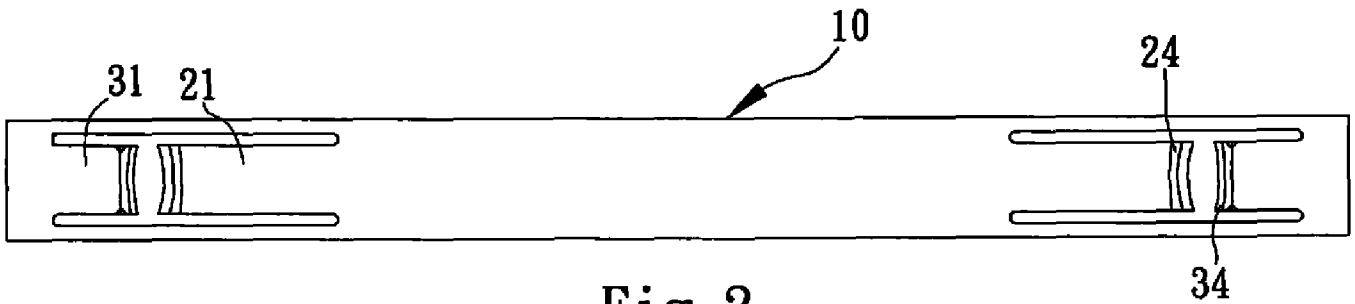
FIG. 2 is a top plan view of the first embodiment according to the present invention.
Figure 3:
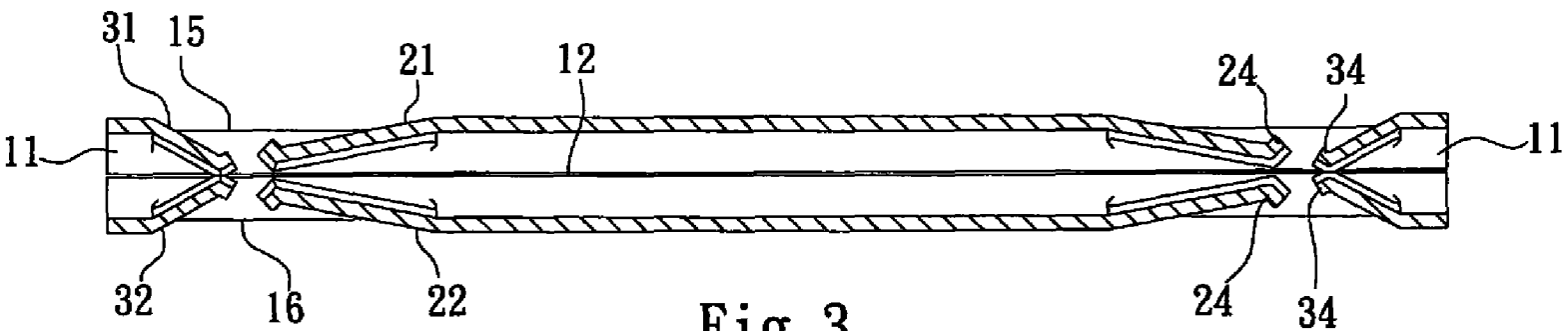
FIG. 3 is a cross-sectional view of the first embodiment according to the present invention.
Figure 4:
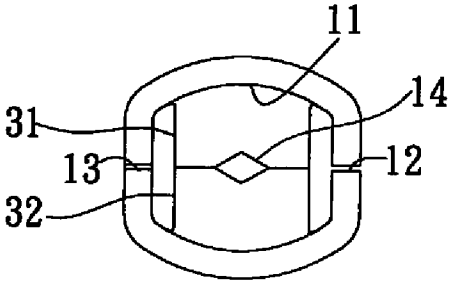
FIG. 4 is an end view of the first embodiment according to the present invention.

With reference to the drawings and in particular to FIGS. 1-4, an improved structure of central conductor of coaxial cable connector is shown, comprising a hollow barrel 10, at least one first spring plate group 20, and at least one second spring plate group 30.

The barrel 10 has a front end and a rear end in an axial direction, which respectively form connection bores 11. The barrel 10 has opposite, left and right side surfaces, which respectively form a first slit 12 and a second slit 13. The barrel 10 has top and bottom walls 101, 102, which form at least one top wall opening 15 and at least one bottom wall opening 16 corresponding to each other. The first slit 12 is a continuous slit that extends from the connection bore 11 of the front end of the barrel 10 to the connection bore 11 of the rear end of the barrel 10, while the second slit 13 is an interrupted slit of two segments respectively extending from the connection bore 11 of the front end of the barrel 10 and the connection bore 11 of the rear end of the barrel 10 toward an axial center of the barrel 10 to improve resiliency limit thereof. (Alternatively, the second slit 13 may be composed of a single segment either extending from the connection bore 11 of the front end of the barrel 10 toward the axial center of the barrel 10 or extending from the connection bore 11 of the rear end of the barrel 10 toward the axial center of the barrel 10.)

The first spring plate group 20 comprises two spring plates 21, 22, which are arranged to engage each other from upper and lower sides. Each of the spring plates 21, 22 has one end connected and fixed to the top or bottom wall 101, 102 of the barrel 10 and an opposite end of the spring plate 21, 22 is arranged to extend inward of the top wall opening 15 or the bottom wall opening 16.

The second spring plate group 30 is arranged opposite, in direction, to the first spring plate group 20. The second spring plate group 30 comprises two spring plates 31, 32, which are arranged to engage each other from the upper and lower sides. Each of the spring plates 31, 32 has one end connected and fixed to the top or bottom wall 101, 102 of the barrel 10 and an opposite end of the spring plate 31, 32 is arranged to extend inward of the top wall opening 15 or the bottom wall opening 16. The spring plates 21, 22 of the first spring plate group 20 and the spring plates 31, 32 of the second spring plate group 30 each have an end that is bent to form a free section 24, 34, which leads in and out an internal conductor of a coaxial cable. The spring plates 21, 22, 31, 32 of each of the spring plate groups 20, 30, as being set in engagement with each other, form a rhombic (or substantially rhombic) opening 14 to increase contact area and provide excellent engagement between conductors.

As such, the present invention provides a multi-point engagement structure, which helps providing an improved clamping force after an internal conductor of a coaxial cable is inserted and thereby prevents the internal conductor of the coaxial cable from being pulled off. Further, the contact area is increased so that potential interruption of signal transmission can be eliminated.

It is noted here that according to the present invention, the first spring plate group 20 and the second spring plate group 30 are arranged opposite, in direction to each other. This arrangement takes into consideration that for an arrangement where the first spring plate group 20 and the second spring plate group 30 are set up in the same direction, after multiple insertion and retraction of the internal conductor of the coaxial cable, a forward movement of the internal conductor may cause resiliency fatigue of the spring plates and thus loss of clamping force and a reversed movement may cause break or damage of the spring plates and thus failure of functionality; on the other hand, for an arrangement where the first spring plate group 20 and the second spring plate group 30 are set up in opposite directions, when a forward movement causes resiliency fatigue of one spring plate group (such as he second spring plate group 30) and thus makes the clamping force of the one spring plate group, the other spring plate group (such as the first spring plate group 20) still provides a sufficient clamping force and when a reversed movement cause break or damage of one spring plate group (such as the first spring plate group 20) and thus failure of functionality thereof, the other spring plate group (such as the second spring plate group 30) still maintains normal functionality.

Figure 5:
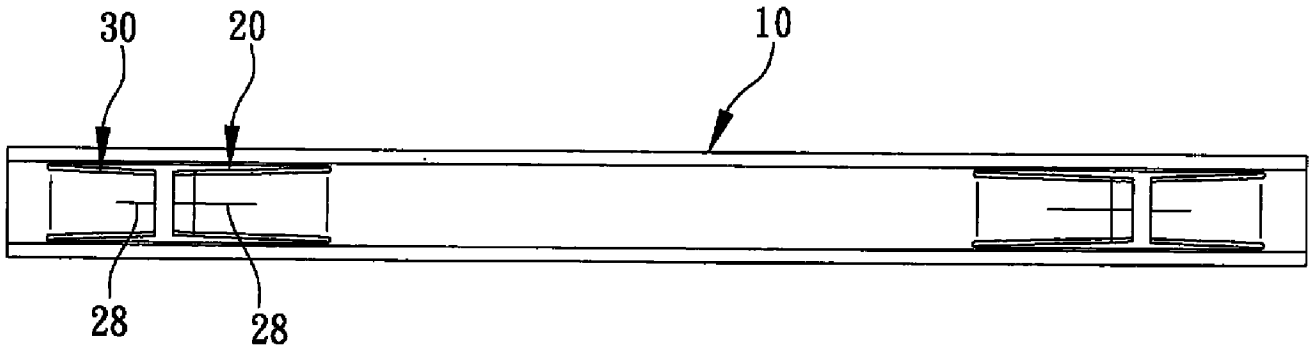
FIG. 5 is a top plan view of a modification of the first embodiment according to the present invention, wherein spring plates are provided with slits.

Further, as shown in FIG. 5, the spring plates 21, 22 of the first spring plate group 20 and the spring plates 31, 32 of the second spring plate group 30 may each form an axially extending third slit 28 to increase the contact area and improve quality of signal receiving.

In the first embodiment, the barrel 10 forms (in the front and rear ends thereof) two top wall openings 15 and two bottom wall openings 16 and comprises two first spring plate groups 20 and two second spring plate groups 30, which are arranged in an opposite manner. The spring plates 21, 22 of the first spring plate group 20 and the spring plates 31, 32 of the second spring plate group 30 are arranged in the form of two mutually-pointing V-shapes (an example being visible in left-hand side portion of FIG. 3, where the left V-shape is formed of the spring plates 31, 32 of the second spring plate group 30, while the right V-shape is formed of the spring plates 21, 22 of the first spring plate group 20, but not limited thereto). The arrangement of multiple first spring plate groups 20 and multiple second spring plate groups 30 helps further improving clamping force and increasing contact area. The spring plates 21, 22 of the first spring plate group 20 and the spring plates 31, 32 of the second spring plate group 30 each have an end that is bent to form a free section 24, 34 to help leading in and out of the internal conductor of the coaxial cable and preventing break or damage of the spring plates 21, 22, 31, 32. Further, the arrangement of the first slit 12 and the second slit allows of flexibly changing of the diameters of the connection bores 11 on the front and rear ends of the barrel 10 so as to improve the applicability to various specifications of internal conductor of coaxial cables.

Second Embodiment

Figure 6:
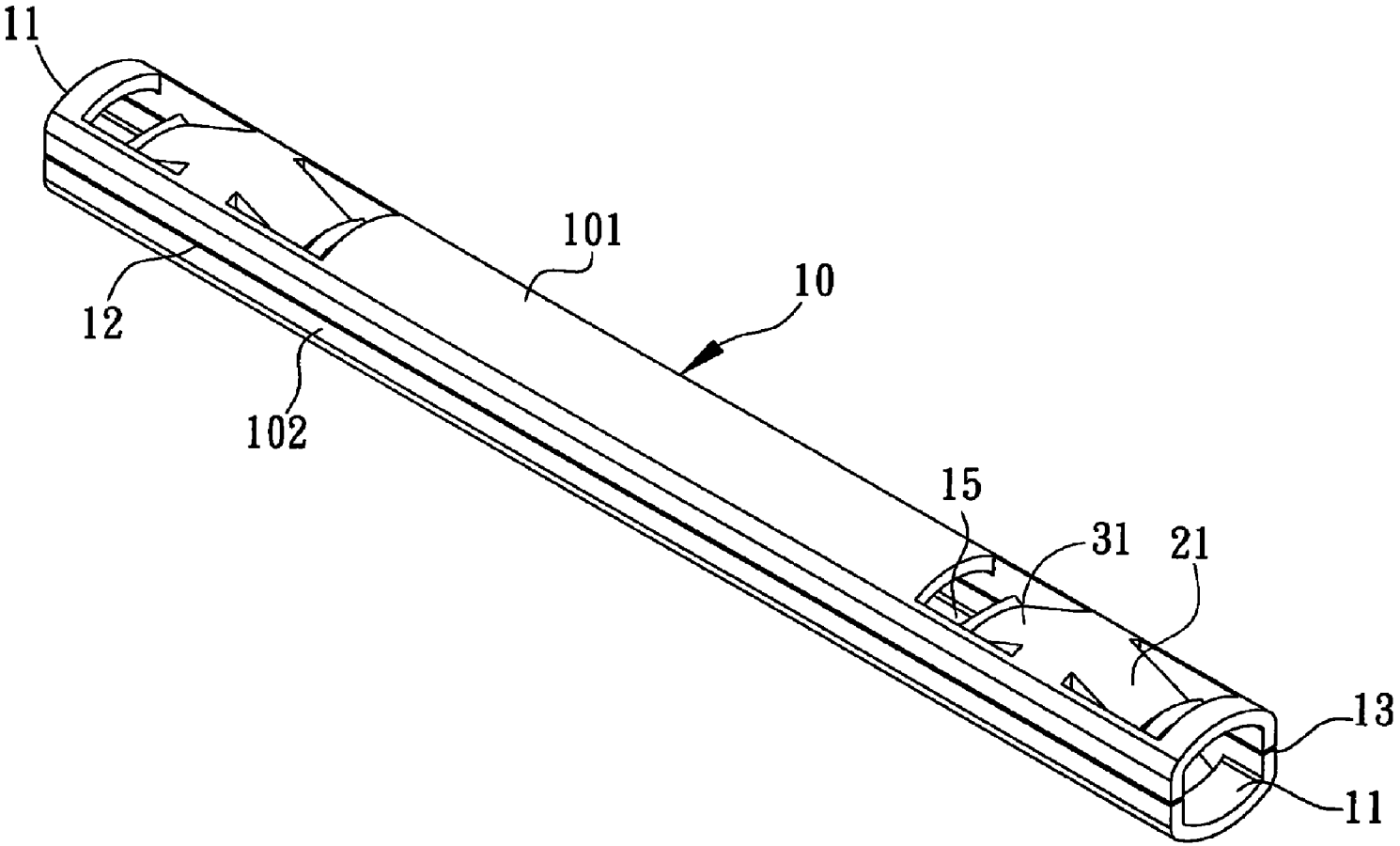
FIG. 6 is a perspective view of a second embodiment according to the present invention.
Figure 6A:
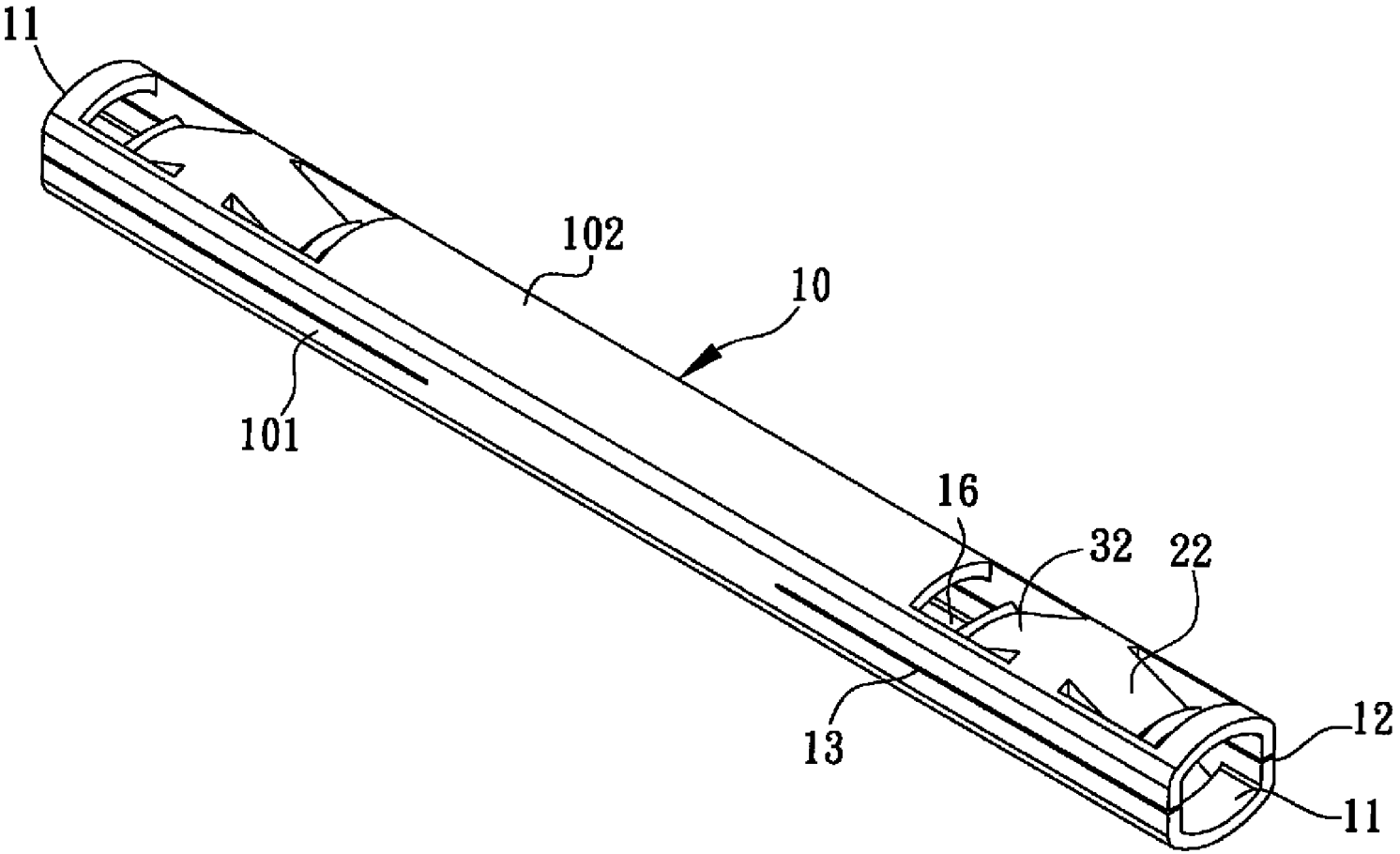
FIG. 6A is a different perspective view of the second embodiment according to the present invention.

With reference to FIG. 6, a second embodiment of a central conductor of coaxial cable connector according to the present invention is shown. The second embodiment is different from the above-described first embodiment in that the spring plates 21, 22 of the first spring plate group 20 and the spring plates 31, 32 of the second spring plate group 30 are arranged in directions that are opposite to those of the first embodiment and thus present an arrangement of two pointing-away V-shapes. This provides the same advantage as that of the first embodiment.

Third Embodiment

Figure 7:
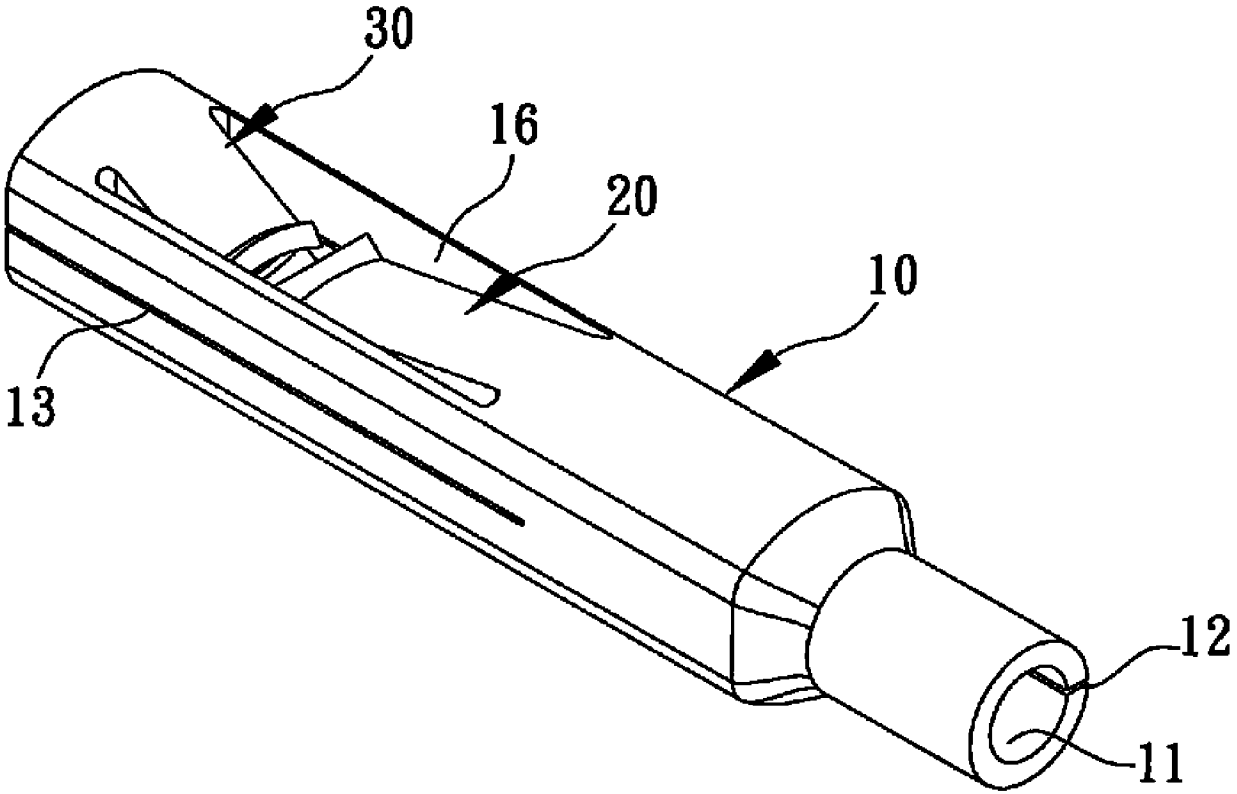
FIG. 7 is a perspective view of a third embodiment according to the present invention.
Figure 7A:
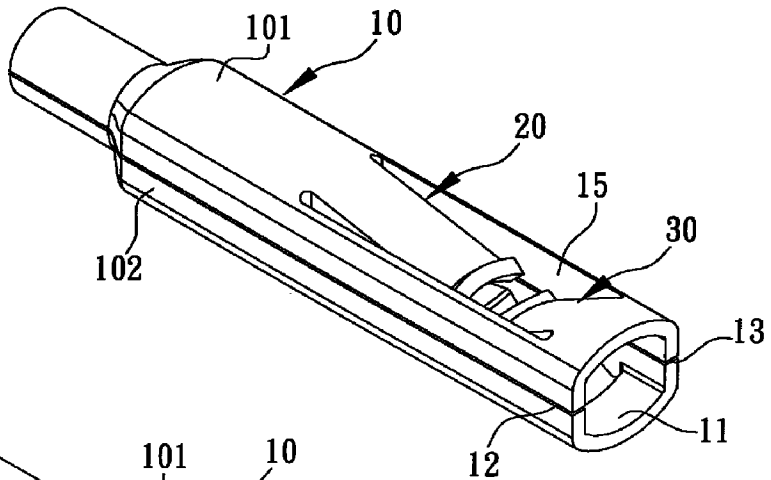
FIG. 7A is a different perspective view of the third embodiment according to the present invention.
Figure 7B:
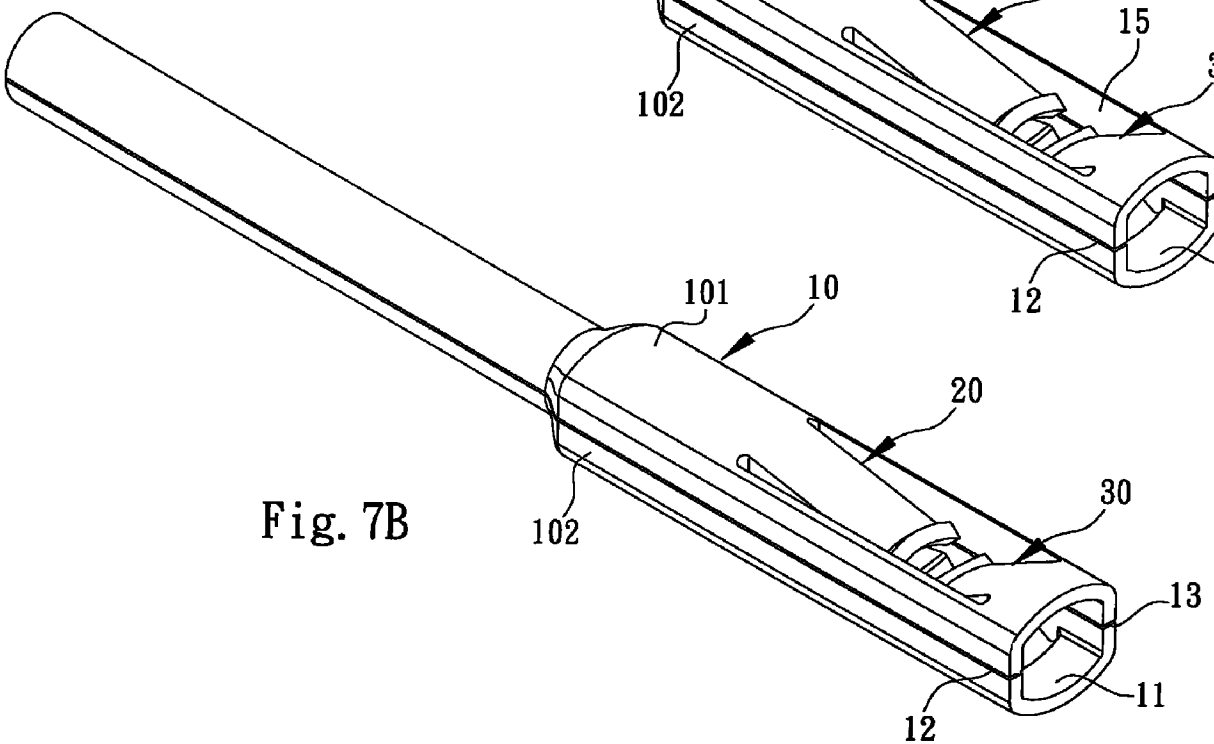
FIG. 7B is a perspective view showing a modification of the third embodiment of FIG. 7A, wherein an end is extended.

Referring to FIGS. 7 and 7A, a third embodiment of central conductor of coaxial cable connector according to the present invention is shown and is different from the first embodiment in that the barrel 10 has one end (front end or rear end) that is reduced, in a stepwise manner, to form a cylindrical tube for connection with connectors of different specifications and thereby improving applicability of the present invention to diverse electronic products. It is apparent that the cylindrical end of the barrel 10 can be extended as desired, as shown in FIG. 7B.

Fourth Embodiment

Figure 8:
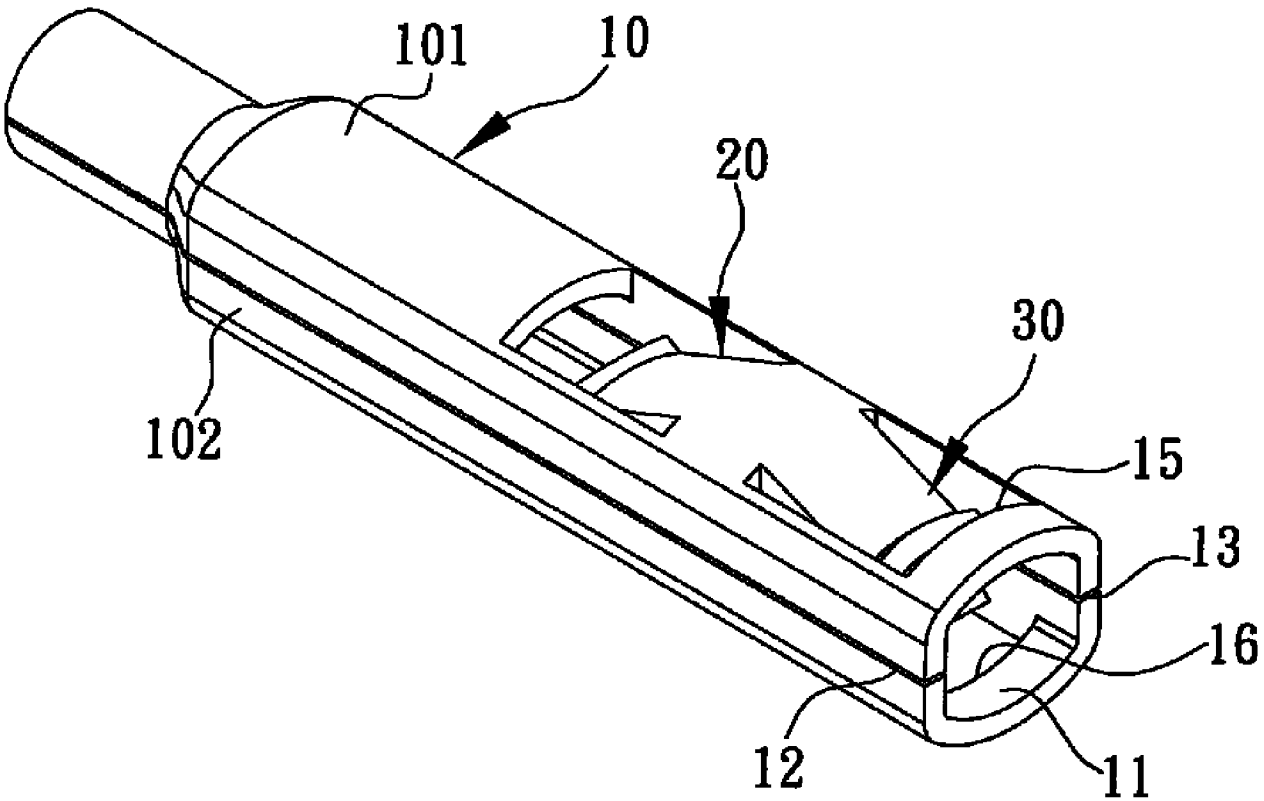
FIG. 8 is a perspective view of a fourth embodiment according to the present invention.

Referring to FIG. 8, a fourth embodiment of central conductor of coaxial cable connector according to the present invention is shown and is different from the second embodiment the barrel 10 has one end (front end or rear end) that is reduced, in a stepwise manner, to form a cylindrical tube for connection with connectors of different specifications and thereby improving applicability of the present invention to diverse electronic products. It is apparent that the cylindrical end of the barrel 10 can be extended as desired.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A central conductor of coaxial cable connector, comprising:

a hollow barrel, which has front and rear ends each forming a connection bore, opposite left and right side surfaces respectively forming a first slit and a second slit, and top and bottom walls respectively forming at least one top wall opening and at least one bottom wall opening corresponding to each other;

at least one first spring plate group, which comprises two spring plates that engage each other from upper and lower sides, each of the spring plates having an end connected to one of the top and bottom walls of the barrel and an opposite end extending inward of one of the top wall opening and the bottom wall opening; and at least one second spring plate group, which is arranged opposite, in direction, to the first spring plate group, the second spring plate group comprising two spring plates that engage each other from upper and lower sides, each of the spring plates having an end connected to one of the top and bottom walls of the barrel and an opposite end extending inward of one of the top wall opening and the bottom wall opening, wherein the upper side spring plates of the first and second spring plate group form a V-shape slope situated on top wall opening, and the lower side spring plates of first and second spring plate group form an upside down V-shape slope situated on bottom wall opening, so that the first spring plate group and the second spring plate group collectively form a multiple-point engagement structure.

2. The central conductor of coaxial cable connector as claimed in claim 1, wherein the first slit comprises a continuous slit extending from the connection bore of the front end of the barrel to the connection bores of the rear end of the barrel.

3. The central conductor of coaxial cable connector as claimed in claim 1, wherein the second slit comprises an interrupted slit formed of two segments respectively extending from the connection bore of the front end of the barrel and the connection bore of the rear end of the barrel toward a center of the barrel.

4. The central conductor of coaxial cable connector as claimed in claim 1, wherein the spring plates of the first spring plate group and the spring plates of the second spring plate group each have an end bent to form a free section.

5. The central conductor of coaxial cable connector as claimed in claim 1, wherein the spring plates of the first spring plate group and the spring plates of the second spring plate group form a rhombic opening as being set in engagement condition.

* * * * *